US007285038B1

(12) United States Patent
Jioia

(10) Patent No.: US 7,285,038 B1
(45) Date of Patent: Oct. 23, 2007

(54) SANDING ATTACHMENT FOR A RECIPROCATING POWER TOOL

(76) Inventor: Les Jioia, 166 Twombly Ave., Staten Island, NY (US) 10306

( * ) Notice: Subject to any disclaimer, the term of this patent is extended or adjusted under 35 U.S.C. 154(b) by 0 days.

(21) Appl. No.: 11/490,462

(22) Filed: Jul. 20, 2006

Related U.S. Application Data

(63) Continuation-in-part of application No. 10/771,479, filed on Feb. 4, 2004, now abandoned.

(51) Int. Cl.
*B24B 1/00* (2006.01)
*B24B 27/08* (2006.01)

(52) U.S. Cl. ..... 451/28; 451/356

(58) Field of Classification Search ..... 451/28, 451/356, 344, 490, 512, 502, 461
See application file for complete search history.

(56) References Cited

U.S. PATENT DOCUMENTS 3,007,230 A * 11/1961 Riedl ..... 451/356
3,914,906 A * 10/1975 Barnes ..... 451/356
3,953,944 A * 5/1976 Olson ..... 451/356
4,128,970 A * 12/1978 Sawrenko ..... 451/356
4,707,947 A * 11/1987 Harris ..... 451/461
5,209,022 A * 5/1993 McCambridge ..... 451/461
6,678,959 B1 * 1/2004 Phillip et al. ..... 451/356
6,899,593 B1 * 5/2005 Moeller et al. ..... 451/356

* cited by examiner

*Primary Examiner*—Hadi Shakeri
(74) *Attorney, Agent, or Firm*—Goldstein Law Offices, P.C.

(57) ABSTRACT

A sanding attachment, for use in conjunction with an existing reciprocating power tool, for sanding a rough surface of an existing object. The sanding attachment comprises a main part being an elongated strip of metal having an attachment end for selective attachment to the power tool, and a sanding end. Attached to the sanding end is a sanding pad having a sanding surface for efficiently sanding an object. The sanding attachment has a twist which results in the attachment end and the sanding end being substantially mutually perpendicular to one another. After the sanding attachment has been selectively attached to the power tool, and the power tool is held within the hands of the user is the usual fashion, the sanding attachment is suitably positioned for efficiently sanding a substantially horizontal surface.

11 Claims, 4 Drawing Sheets

SANDING ATTACHMENT FOR A RECIPROCATING POWER TOOL

CROSS REFERENCES AND RELATED SUBJECT MATTER

This application is a continuation-in-part of patent application Ser. No. 10/771,479, filed in the United States Patent Office on Feb. 4, 2004 now abandoned.

BACKGROUND OF THE INVENTION

1. Field of the Invention

The invention generally relates to an accessory for a power tool, and in particular relates to a sanding attachment for a reciprocating power tool.

2. Description of the Related Art

Reciprocating power tools are utilized for performing tasks wherein rapid back-and-forth motion of an attachment, such as a saw blade, is required. By way of example, a Sawzall reciprocating saw is utilized for rapidly and efficiently cutting wood and other construction materials. Many existing reciprocating tools are not furnished with sanding attachments for abrading a rough surface of an existing object, or if they are so furnished, the attachment provided is not suitably configured to rapidly and efficiently abrade rough surfaces. Accordingly, there is a need for a sanding attachment which is selectively and easily attachable to an existing reciprocating power tool, comprising an elongated strip having a substantially ninety degree twist so that the attachment end is perpendicular to the sanding end, thereby providing a sanding attachment which is suitably configured to rapidly and efficiently abrade a rough surface of an existing object, particularly when the surface of the object is substantially horizontal.

A variety of reciprocating tools, and sanding attachments for these tools, are available. For example, U.S. Pat. No. 5,658,193 to McCambridge appears to show a reciprocating tool having a plurality of working attachments for performing tasks involving reciprocating motion, such as sanding, grinding, sawing, cutting, and polishing. Moreover, U.S. Pat. No. 5,484,328 to Osterman appears to show a sanding tool for use in conjunction with an electric motor, for sanding, polishing, and finishing an arcuate shaped workpiece.

Furthermore, U.S. Pat. No. 5,022,189 to Saul appears to show a sander extension device for attachment to an oscillating or vibrating sander, for sanding convex or concave surfaces, having a flexible metallic strip to which a pad of sandpaper is detachably secured, wherein the metallic strip is capable of being manually guided to conform to the desired contours of the article being sanded. Additionally, U.S. Pat. No. 6,129,617 to Adams appears to show an abrasive sanding attachment for a reciprocating saw, capable of being fitted and mounted in a blade holder of a scroll saw. In addition, U.S. Pat. No. 5,707,276 to Holko et al appears to show an abrader blade with slidable depth control wings for limiting the extent of abrasion. Also, U.S. Pat. No. D296,980 to Chaconas appears to show an ornamental design for a tip for a saw blade.

U.S. Pat. No. 3,913,906 to Barnes discloses a sanding blade for a reciprocating saw. U.S. Pat. No. 6,149,510 to Romagnoli discloses an abrading blade for use with a reciprocating saw.

While these devices may be suitable for the particular purpose employed, or for general use, they would not be as suitable for the purposes of the present invention as disclosed hereafter.

SUMMARY OF THE INVENTION

It is an object of the invention to provide a sanding attachment, which is readily attachable to an existing power tool such as a Sawzall reciprocating saw. Accordingly, the elongated sanding attachment has an attachment end having a tab extending axially therefrom, the tab has a U-shaped slot for selective attachment to a coupling end of the power tool.

It is another object of the invention to provide a sanding attachment for smoothing a rough surface of an existing object. Accordingly, the sanding attachment has a sanding end having a sanding pad attached thereunto. Upon activation of the reciprocating tool, and pressing of the sanding pad against the surface to be smoothed, the sanding pad rapidly moves back and forth against the surface to be abraded, and thereby efficiently smoothes the rough surface of the existing object.

It is yet another object of the invention to provide a sanding attachment suitably configured for efficiently sanding a substantially horizontal surface. Accordingly, the attachment end is at a substantially right angle to the sanding end. After the attachment end is selectively attached to the coupling end of the tool, and the tool is held within the hand or hands of the user in the usual manner, the sanding end is substantially horizontal, thereby allowing the sanding attachment to efficiently abrade the existing substantially horizontal surface.

It is an additional object of the invention to provide a sanding attachment which is suitable for sanding the surfaces of a variety of differently shaped objects. Accordingly, the sanding attachment is provided in a variety of shapes and sizes, in order that it may be suitably used for sanding a wide variety of surfaces.

It is a further object of the invention to provide a sanding attachment which is rugged and will not become damaged or deformed even after repeated use. Accordingly, the sanding attachment is fashioned from a strip of durable, resilient metal, and will not become damaged or deformed even after repeated use.

It is yet another object of the invention to provide a sanding attachment which is not unduly expensive. Accordingly, the sanding attachment is constructed from readily available materials, and its cost is not prohibitive.

It is a still further object of the invention to provide a sanding attachment which allows a variety of sanding operations to be performed. Accordingly, the sanding pad can take the form of a variety of sanding accessories having varied sanding surfaces, that are selectively attached to the sanding end.

The invention is a sanding attachment, for use in conjunction with an existing reciprocating power tool, for sanding a rough surface of an existing object. The sanding attachment comprises an elongated strip of metal of substantially uniform thickness, having an attachment end for selective attachment to the power tool, and a sanding end for abrading and smoothing the rough surface of the existing object. The sanding end has a sanding pad capable of efficiently sanding an object. The sanding attachment has a twist between the sanding end and attachment end which results in the attachment end and the sanding end being substantially mutually perpendicular to one another. After the sanding attachment has been selectively attached to the power tool, and the power tool is held within the hands of the user is the usual fashion, the sanding attachment is suitably positioned for efficiently sanding a substantially horizontal surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
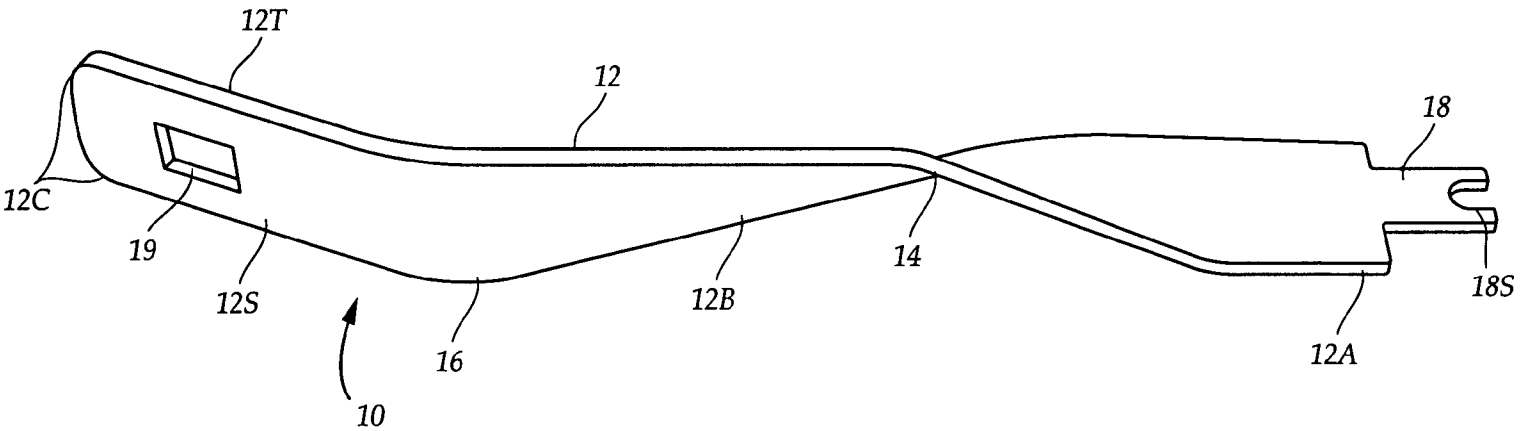
FIG. 1 is a perspective view of a sanding attachment main part.
Figure 3:
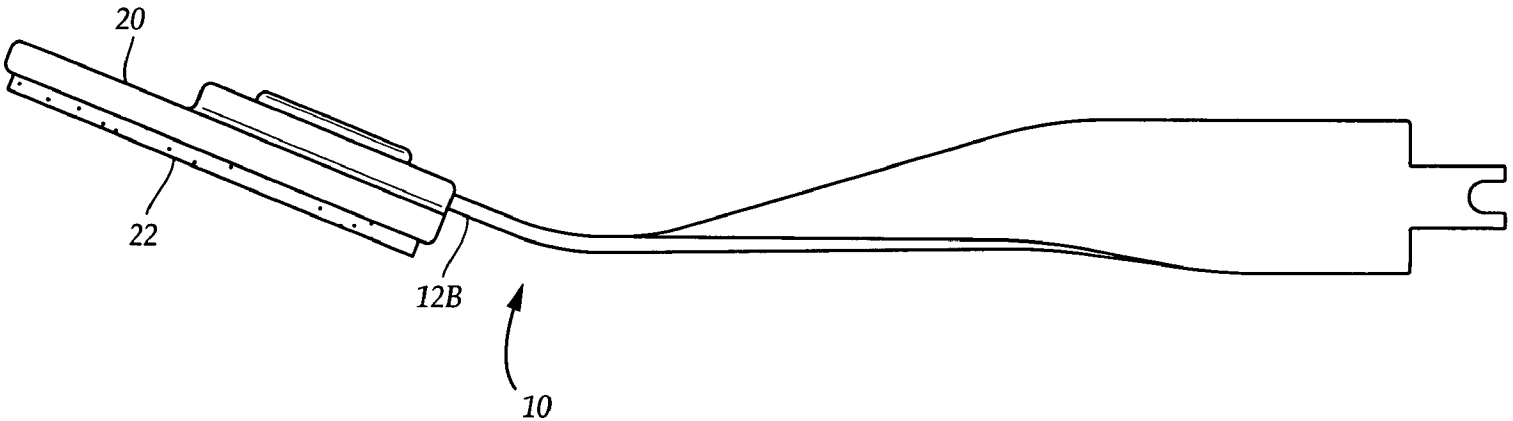
FIG. 3 is a side elevational view, illustrating the sanding pad attached onto the sanding end of the main part.

FIG. 1 illustrates a main part 12 of a sanding attachment 10, for use in conjunction with an existing reciprocating power tool, for sanding rough surfaces of an existing object. The main part 12 comprises an elongated, substantially rectangular strip of metal of substantially uniform thickness, having a top surface 12T, a bottom surface 12B, an attachment end 12A for selective attachment to the power tool, and a sanding end 12S which is directed at a surface to be smoothed or abraded. In this regard, referring to FIG. 3, attached to the bottom surface 12B of the sanding end 12S is a sanding pad 20 having a sanding surface 22. The sanding surface 22 has a plurality of small, raised protuberances for rapidly and efficiently abrading a rough surface when the sanding attachment 10 is being deployed. To accomplish the attachment of the sanding pad 20, the sanding end 12S has a substantially square fastening opening 19 extending fully between the top surface 12T and bottom surface 12B.

The main part 12 is twisted between the attachment end 12A and sanding end 12S such that the top surface 12T at the attachment end 12A is at a substantially ninety degree angle to the top surface 12T at the sanding end 12S. To accomplish the twist, the main part 12 has two bends, namely a first bend 14 more proximal to the attachment end 12A than to the sanding end 12S, and a second bend 16 more proximal to the sanding end 12S than to the attachment end 12A. Each of the bends 14, 16 is a discontinuance of the planarity of the top surface 12T and bottom surface 12B. Once again then, the net result of the two bends, 14 and 16, is that the attachment end 12S and the sanding end 12S are substantially perpendicular to one another. After the sanding attachment 10 has been selectively attached to a reciprocating power tool, and the power tool is held within the hand or hands of the user in the usual fashion, the sanding attachment 10 is suitably positioned for efficiently sanding a substantially horizontal surface.

Figure 2:
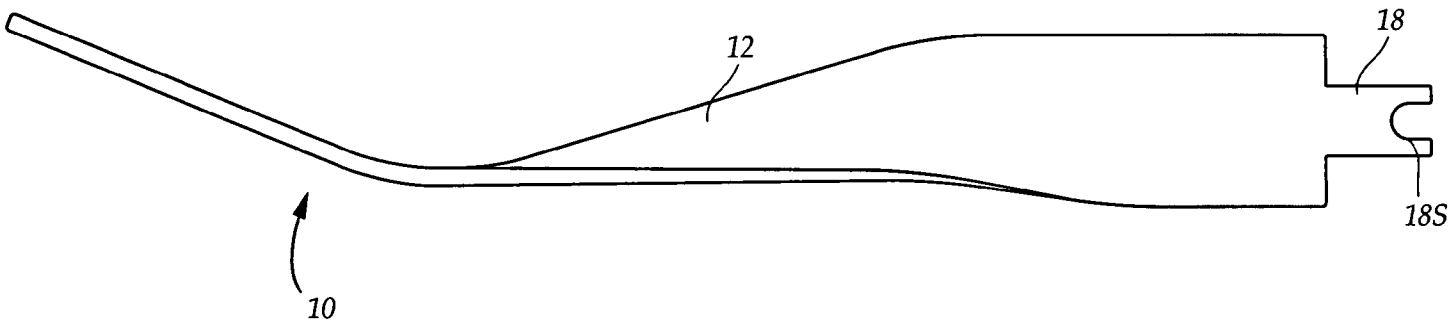
FIG. 2 is a perspective view of the sanding attachment main part, as in FIG. 1, except viewed from a different angle.

FIG. 2 illustrates the main part 12 of the sanding attachment 10, as in FIG. 1, except viewed from a different angle illustrating the twisted nature of the main part 12.

Figure 9:
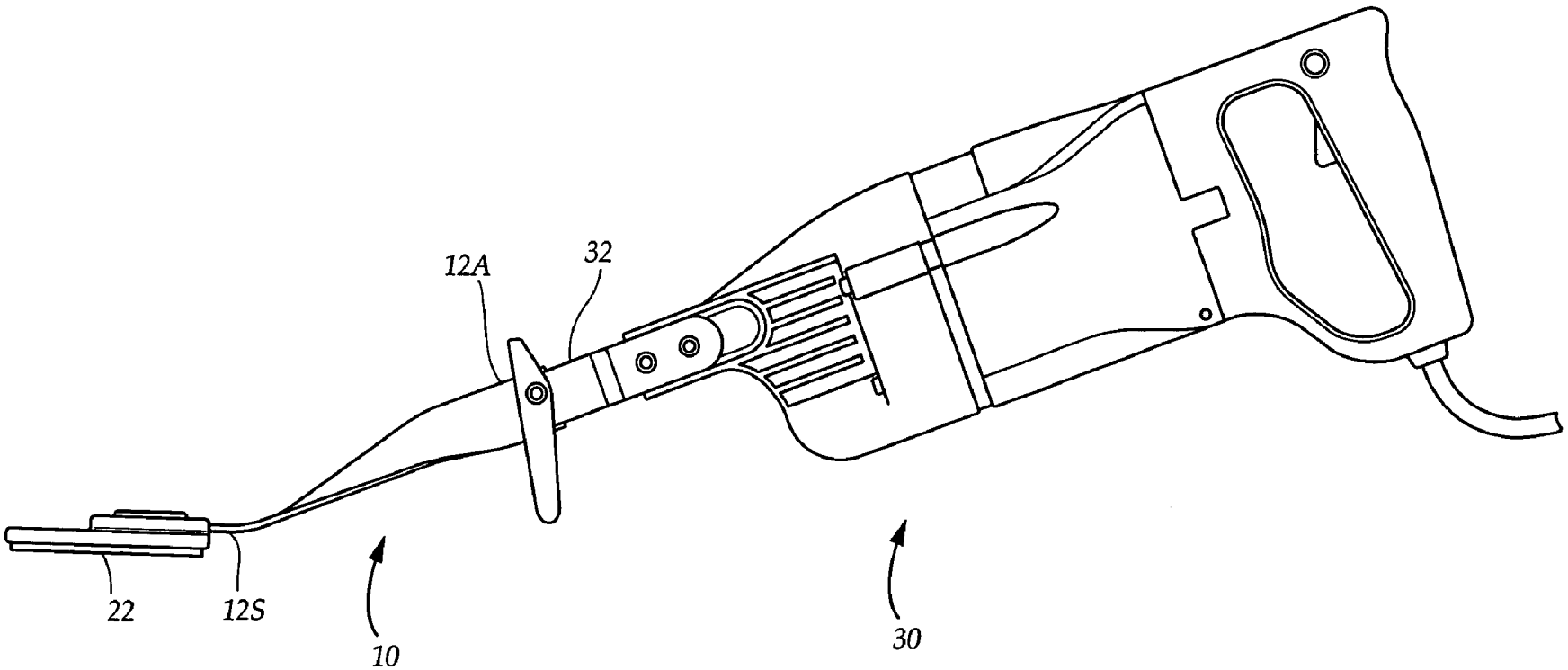
FIG. 9 is a perspective view of the sanding attachment, after it has been selectively attached to an existing reciprocating power tool.

Referring to FIG. 9, the existing reciprocating power tool 30 has a coupling end 32, into which a variety of different attachments may be selectively secured. The attachment end 12A of the sanding attachment 10 has a tab 18 extending axially therefrom, said tab 18 having a U-shaped slot 18S for selectively engaging the coupling end of the power tool. FIG. 9 illustrates the sanding attachment 10 after it has been selectively attached to the coupling end 32 of the reciprocating power tool 30. The sanding end 12S is substantially horizontal.

Returning to FIG. 1, the sanding end 12S has two opposing corners 12C, each of which are rounded so as to prevent accidental injury to the user while the sanding attachment 10 is being deployed in conjunction with the power tool.

Figure 5:
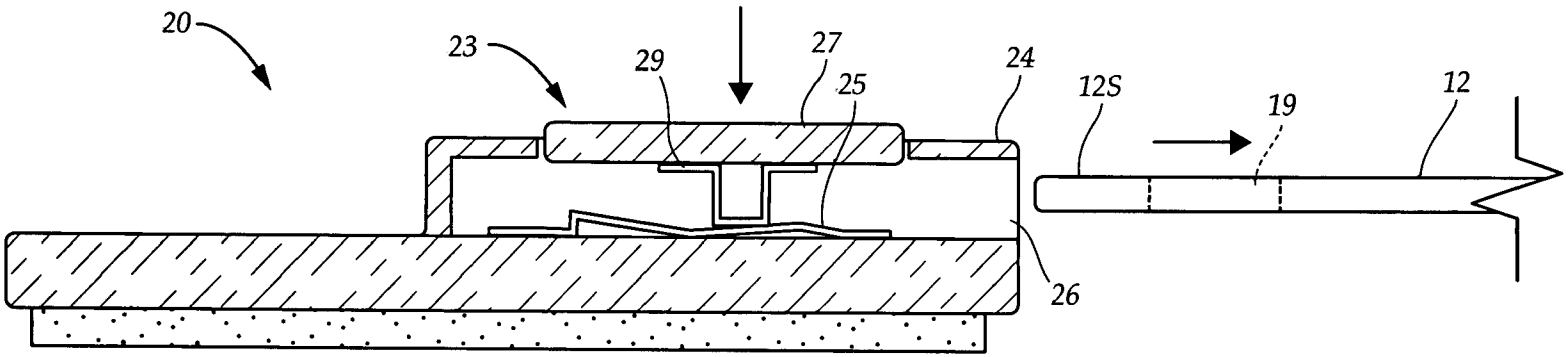
FIG. 5 is a side elevational view, similar to FIG. 4, except wherein the sanding pad has been released from the main part.
Figure 8:
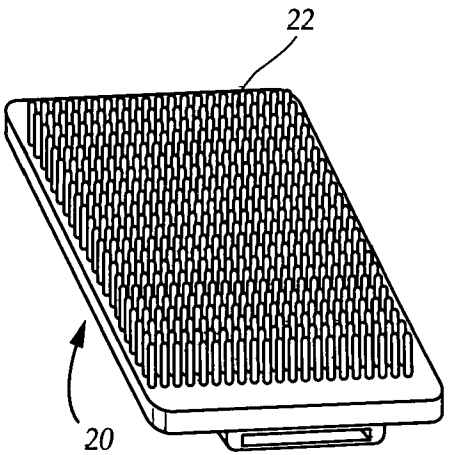
FIGS. 6, 7, and 8 are diagrammatic perspective views, illustrating various embodiments of the sanding pad, for performing various sanding operations.
Figure 7:
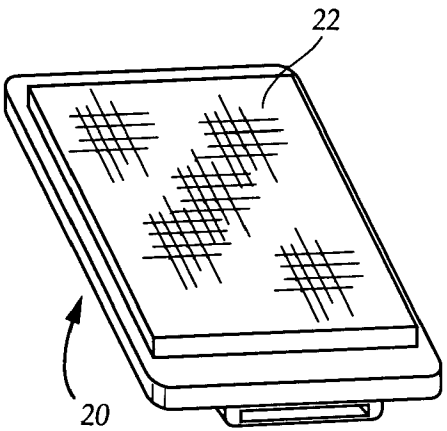
Figure 6:
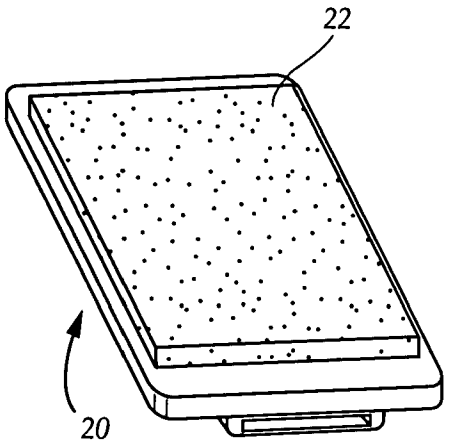

Referring to FIGS. 6, 7, and 8, the sanding pads 20 are provided in a variety of shapes and sizes, in order that it may be suitably used for sanding a wide variety of surfaces. The main part 12 is constructed of a durable resilient metal such as stainless steel, which will not crack even after repeated used. The sanding pad 20 is likewise constructed of a durable metal, and is rigidly affixed to the bottom surface 12B of the sanding end 12S by a mating mechanism 23, see FIGS. 4 and 5. The sanding surface 22 of the sanding pad 20 includes a variety of different items to accomplish different sanding functions, such as sand paper, emery cloth, and a wire brush.

Figure 4:
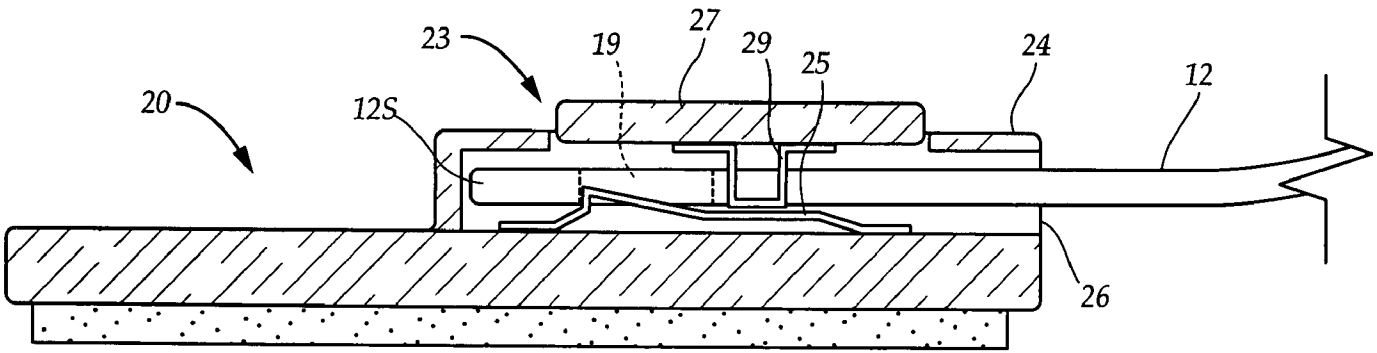
FIG. 4 is a side elevational view, with parts broken away, illustrating a mating mechanism for holding the sanding pad onto the sanding end of the main part, wherein the sanding pad is being held in place thereby.

In FIGS. 4 and 5, as illustrated the sanding pad 20 has a holder 24 having a main slot 26. The main slot 26 selectively accommodates the sanding end 12S of the main part 12 and fastens thereto using the mating mechanism 23. In the example illustrated for the mating mechanism 23, the sanding pad 20 has a holding spring 25 located within the main slot 26; a release button 27 located immediately above the main slot 26; and a pair of detents 29 (one is behind the other in FIG. 4) that each extend alongside the main slot 26 and are capable of deflecting the holding spring 25 to allow the main part 12 to be inserted into the main slot 26, and then releasing the holding spring 25 to allow the holding spring 25 to engage the fastening opening 19 at the sanding end 12S of the main part 12.

Referring to FIG. 5, to release the sanding pad 20 from the main part 12, the release button 27 is pressed, engaging and clearing the holding spring 25 from the fastening opening 19 and allow the sanding end 12S of the main part 12 to be withdrawn from the main slot 26.

Since, as described, the sanding attachment 10 is utilized for sanding a rough surface, a variety of pads 20 are provided with the sanding attachment 10, some of which are capable of grinding, buffing, or polishing an existing object. Although, as described, the sanding attachment 10 has a tab 18 having a U-shaped slot 18S for selective attachment to the coupling end of an existing power tool, a variety of differently configured attachment ends 12A are contemplated, for selective attachment to power tools having coupling ends which are alternately configured.

In use, the sanding attachment 10 is selectively attached by a user to the coupling end of an existing reciprocating power tool, such as a Sawzall reciprocating saw. The user attaches an appropriate sanding pads 20 to the main part. The user holds the power tool in one or both hands of the user and activates the power tool, thereby causing the sanding attachment 10 to move back-and-forth rapidly in an axial direction. The user presses the sanding the sanding pad 20 onto an existing surface which is to be sanded, thereby causing the sanding surface 22 of the sanding pad 12P to rapidly abrade the rough surface. When the surface has been suitably smoothed by the sanding attachment 10, the user turns of the power tool. The sanding attachment 10 may be removed from the coupling end of the power tool, and stored until once again needed.

In conclusion, herein is presented a sanding attachment for use in conjunction with an existing reciprocating power tool. The invention is illustrated by example in the drawing figures, and throughout the written description. It should be understood that numerous variations are possible, while adhering to the inventive concept. Such variations are contemplated as being a part of the present invention.

What is claimed is:

1. A sanding attachment, for use in conjunction with an existing reciprocating power tool having a coupling end into which a variety of different attachments may be selectively fitted, said sanding attachment for sanding rough surfaces of an existing object, comprising:

a main part being an elongated pad of metal of substantially uniform thickness, having a top surface, a bottom surface, an attachment end for selective attachment to the coupling end of the power tool, and a sanding end, the main part having a twist between the end and sanding end such that the sanding end is turned substantially ninety degrees from the attachment end; and a sanding pad, attached to the sanding end for rapidly and efficiently abrading a rough surface while the sanding attachment is being deployed.

2. The sanding attachment as recited in claim 1, wherein the main part has two bends, namely, a first bend more proximal to the attachment end than to the sanding end, and a second bend more proximal to the sanding end than to the attachment end, wherein each of the bends is a discontinuance of the planarity of the top surface and the bottom surface, and wherein the net result of the two bends is that the attachment end and the sanding end are substantially mutually perpendicular to one another, thereby providing a sanding attachment which is substantially positioned for efficiently sanding a substantially horizontal surface, after the sanding attachment has been selectively attached to the power tool, and after the power tool is held within the hand or hands of the user and vertically lowered against the surface to be sanded.

3. The sanding attachment as recited in claim 2, wherein the sanding pad has a main slot for selectively accommodating the sanding end of the main part.

4. The sanding attachment as recited in claim 3, wherein the main part has a fastening opening extending fully between the top surface and the bottom surface near the sanding end, and wherein the sanding pad selectively engages the fastening opening to secure the main part within the main slot of the sanding pad.

5. The sanding attachment as recited in claim 4, wherein the attachment end has a tab extending axially therefrom, said tab having a U-shaped slot for selectively engaging the coupling end of the power tool.

6. The sanding attachment as recited in claim 5, wherein the sanding pad has a holder, having the main slot, and a sanding surface for engaging the horizontal surface to be sanded.

7. The sanding attachment as recited in claim 6, wherein the sanding pad has a release button for selectively disengaging from the main part.

8. The sanding attachment as recited in claim 7, further comprising a plurality of sanding pads, that including sanding surfaces that include sand paper and a wire brush, and are each selectively engaged with the main part.

9. The sanding attachment as recited in claim 8, wherein the sanding end has two opposing corners, each of which are rounded so as to prevent accidental injury to the user while the sanding attachment is being deployed in conjunction with the power tool.

10. The sanding attachment as recited in claim 9, wherein the main part of the sanding attachment is constructed of a durable, resilient material which will not crack even after being repeatedly used.

11. A method of sanding a substantially horizontal, rough surface of an existing object comprising the steps of:

providing a reciprocating power tool having a coupling end into which a variety of attachments may be selectively fitted, with a sanding attachment having a main part being an elongated pad of metal of substantially uniform thickness, having a top surface, a bottom surface, an attachment end for selective attachment to the coupling end of the power tool, and a sanding end, the main part having a twist between the attachment end and sanding end such that the sanding end is turned substantially ninety degrees from the attachment end;

attaching the attachment end of the sanding attachment to the coupling end of the power tool;

attaching a sanding pad to the sanding end of the main part;

holding the power tool such that the sanding end is substantially horizontal;

activating the power tool, thereby causing the sanding attachment to move back-and-forth rapidly in a horizontal, axial direction;

vertically lowering the power tool, and thereby pressing the sanding pad onto the surface to be sanded, thereby causing an abrasive surface of the sanding pad to rapidly abrade the rough surface of the object to be sanded;

deactivating the power tool after the surface has been smoothed by the sanding attachment;

removing the attachment end of the sanding attachment from the coupling end of the power tool; and storing the sanding attachment until once again needed.

* * * * *